US009232311B2

(12) United States Patent
Hoang Co Thuy

(10) Patent No.: US 9,232,311 B2
(45) Date of Patent: Jan. 5, 2016

(54) METHOD FOR PROCESSING AN AUDIO SIGNAL WITH MODELING OF THE OVERALL RESPONSE OF THE ELECTRODYNAMIC LOUDSPEAKER

(71) Applicant: PARROT, Paris (FR)

(72) Inventor: Vu Hoang Co Thuy, Paris (FR)

(73) Assignee: Parrot, Paris (FR)

( * ) Notice: Subject to any disclaimer, the term of this patent is extended or adjusted under 35 U.S.C. 154(b) by 253 days.

(21) Appl. No.: 13/927,980

(22) Filed: Jun. 26, 2013

(65) Prior Publication Data

US 2014/0064502 A1 Mar. 6, 2014

(30) Foreign Application Priority Data

Aug. 30, 2012 (FR) ..... 12 58116

(51) Int. Cl.
*H04R 29/00* (2006.01)
*H04R 3/04* (2006.01)

(52) U.S. Cl.
CPC ..... *H04R 3/04* (2013.01); *H04R 29/003* (2013.01)

(58) Field of Classification Search
CPC .... H04R 29/00; H04R 29/003; H04R 29/001; H04R 3/00; H04R 3/08; H04R 3/04
USPC ..... 381/55, 56, 57, 58, 59
See application file for complete search history.

(56) References Cited

U.S. PATENT DOCUMENTS 6,058,195 A * 5/2000 Klippel ..... H04R 3/02 381/150
2004/0178852 A1* 9/2004 Neunaber ..... H03F 1/52 330/284

OTHER PUBLICATIONS

Ricardo Adriano Ribeiro et al., "Application of Kalman and RLS Adaptive Algorithms to Non-Linear Loudspeaker Controller Parameter Estimation: A Case Study", 2005 IEEE International Conference on Acoustics, Speech, and Signal Processing,vol. 3, pp. 145-148.*
Marcus Arvidsson et al., "Attenuation of Harmonic Distortion in Loudspeakers Using Non-Linear Control", Jun. 18, 2012, XP055053802, URL://liu.diva-portal.org/smash/get/diva:534340/FULLTEXT01.*
David Jakobosson et al., "Modelling and Compensation of Nonlinear Loudspeaker", Master's Thesis in Systems, Control and Mechatronics, Jan. 1, 2010, XP055053800, URL://publications.lib.chalmers.se/records/fulltext/126003.pdf.

* cited by examiner

*Primary Examiner* — Vivian Chin
*Assistant Examiner* — Ammar Hamid
(74) *Attorney, Agent, or Firm* — Haverstock & Owens LLP

(57) ABSTRACT

The method comprises the determination of an observation vector that comprises only electrical measurements of the voltage ($U_{mes}$) at the loudspeaker terminals and of the current (i) passing through the loudspeaker, and a state vector (X) whose components comprise: values of linear parameters of the loudspeaker response such as the electrical ($R_e$) and mechanical ($R_{eq}$) resistance, and polynomial coefficients of nonlinear parameters such as the force factor (BI), the equivalent stiffness ($K_{eq}$) and the electrical inductance ($L_e$). The voltage and current measurements are applied to an estimator with a predictive filter of the extended Kalman filter incorporating a representation of a dynamic model of the loudspeaker. This filter operates a prediction of the state vector (X) and readjusts this prediction by calculation of an estimate ($U_{est}$) of the voltage based on the state vector and on the measured current and comparison of this estimate with the measurement ($U_{mes}$) of the voltage.

6 Claims, 2 Drawing Sheets

METHOD FOR PROCESSING AN AUDIO SIGNAL WITH MODELING OF THE OVERALL RESPONSE OF THE ELECTRODYNAMIC LOUDSPEAKER

FIELD OF THE INVENTION

The invention relates to a technique for processing an audio signal based on the estimation of the overall response of a loudspeaker intended to reproduce this audio signal, i.e. taking into account all the electrical, mechanical and acoustical parameters characterizing this response.

BACKGROUND OF THE INVENTION

The matter is to model the physical behavior of the loudspeaker to simulate the operation thereof when the audio signal is applied thereto after amplification, so that various corrective processing operations can be performed upstream on this audio signal in order to optimize the quality of the final acoustical reproduction rendered to the listener.

In particular, it is current to reinforce the low frequencies to compensate for the fact that the loudspeakers dedicated to this register, or woofers, which are generally installed in open (vent system) or closed baffles, are always more or less limited in the rendering of the deepest frequencies, the low limit (referred to as the baffle cut-off frequency) depending on the size of the loudspeaker, the volume of the baffle and the type of mounting used.

However, if the level of the electrical signal is increased in the low frequencies by a suitable, analog or digital, filtering, the excursion of the loudspeaker diaphragm, i.e. the amplitude of its displacement with respect to its equilibrium position, becomes rapidly too high, with a risk of damaging the loudspeaker, and, at the very least, the introduction, for excessive excursion values, of distortions, clippings and saturations that rapidly deteriorate the rendering quality of the audio signal.

Knowing the overall response of the loudspeaker allows anticipating this risk, to limit if need be the level of the signal to be reproduced in order to avoid excessive excursions or nonlinearities that generate distortions. Another type of conceivable processing consists in applying to the audio signal a specific filtering for compensating for the nonlinearities introduced by the loudspeaker, so as to reduce the audio distortions and to provide a better listening quality.

The matter is then, independently of any limitation of the maximal excursion, to make the loudspeaker diaphragm displacement the more linear possible, in particular for the deepest frequencies, by compensating for the physical limitations of the loudspeaker response in this register, in the vicinity and below the acoustical cut-off frequency of the loudspeaker/baffle unit.

Knowing the parameters that model the overall response of the loudspeaker is essential to perform such processing operations.

These parameters are conventionally those referred to as "Thiele and Small" (T/S), which describe a modeling of an electrodynamic loudspeaker taking into account the various electrical, mechanical and acoustical phenomena involved in the reproduction of the signal, as well as the electromechanical and mechanical-acoustical conversions. The loudspeaker response, in particular for the low frequencies, may then be described by a set of parameters, uniformly referenced by the loudspeaker manufacturers.

These T/S parameters are however not constant in time, nor linear.

firstly, they are liable to drift over time, as a function for example of the loudspeaker ageing, the heating during use, etc.;

secondly, if it is desired to have a precise and realistic modeling of the loudspeaker behavior, it must be taken into account that some of these parameters are not linear, i.e. their values are not fixed but varies constantly as a function of the instantaneous excursion, i.e. the position at a given instant of the loudspeaker moving coil and diaphragm with respect to the central equilibrium position. It is in particular the case for the electrical inductance, the total mechanical stiffness of the system (the stiffness of the diaphragm increasing as the latter goes away from its equilibrium position) and the diaphragm driving "force factor" (linked to the magnetic field of the coil gap, it decreases as the coil goes away from the equilibrium position).

The EP 1 799 013 A1 describes a technique for predicting the behavior of a loudspeaker, based on the T/S parameters, so as to compensate for the nonlinearities of the loudspeaker and to reduce the audio distortions introduced in the acoustic signal rendered to the user.

The T/S parameters are however considered therein as invariants, which are known a priori, so that the response modeling is fixed and cannot take into account the slow evolutions of the parameters, dues for example to their drift over time on account of the ageing of the components.

The US 2003/0142832 A1 describes a technique of adaptive estimation of the parameters of a loudspeaker, including nonlinear parameters, based on the measurement of the current through this loudspeaker, with implementation of a gradient descent algorithm. This method requires a previous determination of the parameters during a static calibration phase: during this calibration, the T/S parameters are calculated for various position values of the diaphragm (offset with respect to the equilibrium position), with measurement of the impedance. Thereafter, a measurement of the current is compared to an estimation of this same current (squared and filtered by a low-pass filter) to calculate the derivative of the error with respect to each parameter. The technique also implements a gradient descent algorithm, of the Least Means Square (LSM) type.

This method however suffers from the drawback that it requires a previous calibration phase with impedance measurements and application of a predetermined signal, which excludes a re-estimation of the subsequent parameters, anyway by a general public user. On the other hand, the simple algorithms of the gradient-descent LMS type do not take into account the measurement noises, which are inevitable, so that the estimator is rather little efficient in real cases of use.

The US 2008/0189087 A1 describes another technique of estimation of the parameters of a loudspeaker, also of the gradient descent LMS type. More particularly, the method processes separately the estimation of the linear part and that of the nonlinear part. For that purpose, the error signal used by the LMS algorithm (difference between the measured signal and the predicted signal) is processed so as to decorrelate the linear part from the nonlinear part. This document also proposes to implement the estimator by applying at the input a particular audio signal, modified by a comb filter that selectively eliminates certain chosen frequencies.

This technique has the same drawbacks as the previous one, in particular the necessity of a calibration based on a modified input signal liable to impair the comfort of listening of the user, which does not allow performing the estimation during music listening, in a transparent manner for the user. Still another method is described in the university paper of Marcus Arvidsson and Daniel Karlsson, *Attenuation of Harmonic Distorsion in Loudspeakers Using Non-Linear Control*, Department of Electrical Engineering, Linköopings Universitet (SE), dated 18 Jun. 2012, XP055053802. This method is based on an observation vector that comprises only measurements of electrical parameters (voltage and current), which are applied to an extended Kalman predictive filter estimator. This estimator performs the prediction of a state vector whose components comprise the value of the excursion and the value of the current in the loudspeaker. But this method does not allow estimating on-the-fly both the linear and nonlinear parameters of the loudspeaker response to thereafter apply a suitable corrective audio processing.

SUMMARY OF THE INVENTION

The problem of the invention is to have at disposal an estimator of the overall response of an electrodynamic loudspeaker:

- which takes into account in the more faithful and the more precise manner all the nonlinearity of this response, as well as the possible drifts of the parameters, by a periodic re-evaluation of these parameters;
- which introduces no modification nor deterioration of the input signal that could impair the comfort of listening of the user;
- which requires for its implementation no previous calibration nor application of a specific signal (white noise, etc.);
- which is immediately operational from any type of music signal, by using this signal "on-the-fly" for the readjustment of the parameters of the estimator—in other words, which can operate transparently for the user, the estimator operating while music is played and based on this music, without the need to ask the user to play a particular type of signal to implement the loudspeaker parameter estimation algorithm; and
- which, in order to be compliant with general public products, requires only the measurement of immediately accessible electrical parameters (voltage at the loudspeaker terminals and intensity in the coil), and can be used with conventional loudspeakers, devoid of electromechanical sensor (displacement sensor, acoustical pressure sensor, etc.)—in other words, where the mechanical displacement of the diaphragm (excursion) remains a "hidden variable", not measured, of the estimator.

For that purpose, the invention proposes a method for processing a digital audio signal of the general type disclosed by the above-mentioned university paper of Arvidsson and Karlsson, i.e. a method comprising:

a) the determination of an observation vector comprising only measurements of electrical parameters, with: a measurement of the voltage at the loudspeaker terminals, and a measurement of the current through the loudspeaker;
b) the determination of a state vector by application of the voltage and current measurements to a predictive filter estimator incorporating a representation of a dynamic model of the loudspeaker,
   this predictive filter being an extended Kalman filter adapted to: operate a prediction of the state vector based on the voltage and intensity measurements, and readjust this prediction by calculation of an estimate of the voltage and comparison of this estimate to the voltage measurement; and
c) the application to the audio signal of a processing that is a function of said state vector.

Characteristically of the invention, the components of the state vector comprise:

- values of linear parameters of the loudspeaker response comprised in the group: electrical resistance and mechanical strength, and
- polynomial coefficients of nonlinear parameters of the loudspeaker response comprised in the group: force factor, equivalent stiffness and electrical inductance.

The processing applied to the audio signal may notably be a processing of compensation for the nonlinearities of the loudspeaker response, as determined based on the state vector delivered by the predictive filter estimator.

As a variant or in addition, the processing applied to the audio signal may comprise: c1) the calculation of a current value of excursion of the loudspeaker as a function i) of an amplification gain of the audio signal and ii) of the loudspeaker response as determined based on the state vector delivered by the predictive filter estimator; c2) the comparison of the thus-calculated current value of excursion with a maximal value of excursion; and c3) the calculation of a possible attenuation of the amplification gain in the case where the current value of excursion exceeds the maximal value of excursion.

Besides, the components of the state vector may comprise values of additional acoustical parameters representative of the loudspeaker response associated with a rear cavity provided with a decompression vent.

Very advantageously, the determination of the state vector of step b) is operated on-the-fly based on the current audio signal object of the processing of step c) and reproduced by the loudspeaker, by collection of the electrical parameters at the loudspeaker terminals during the reproduction of this audio signal.

The method may then comprise the following steps: memorizing a sequence of samples of the audio signal for a predetermined duration; analyzing the sequence for calculating a parameter of energy of the memorized audio signal; if the calculated parameter of energy is higher than a predetermined threshold, activating the estimation by the predictive filter; in the opposite case, inhibiting the estimation by the predictive filter and keeping the previously estimated values of the state vector.

BRIEF DESCRIPTION OF THE DRAWINGS

An example of implementation of the invention will now be described, with reference to the appended drawings in which same reference numbers designate identical or functionally similar elements throughout the figures.

DETAILED DESCRIPTION OF THE INVENTION

Thiele and Small Parameters

Figure 1:
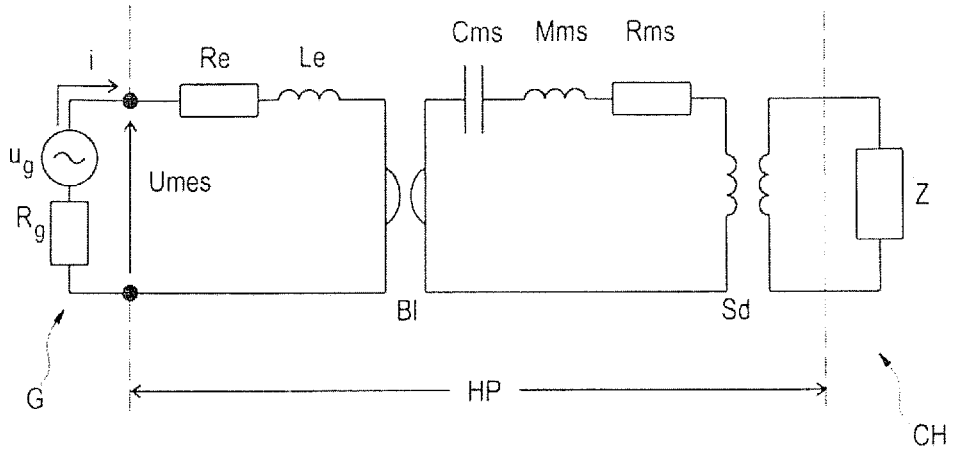
FIG. 1 is an equivalent diagram of an electrodynamic loudspeaker making use of the various T/S parameters modeling the overall response of the latter.

We will first expose, with reference to FIG. 1, the various parameters and equations describing the response of an electrodynamic loudspeaker HP, subjected to an electric excitation by a generator G and delivering a pressure signal on an acoustic load CH.

The left half schematizes the electrical part of the loudspeaker, to which is applied a measurable excitation voltage, Umes, coming from an amplifier producing a current i, also measurable, passing through the loudspeaker coil. The first ratio transformer BI schematizes the electrical to mechanical force conversion applied to the coil. Finally, the ratio gyrator Sd schematizes the mechanical (displacement of the loudspeaker diaphragm) to acoustic pressure conversion.

The various components of this equivalent diagram (resistances, inductances and capacity) model electrical, mechanical (for example, the mass of the coil/diaphragm moving armature) or acoustical (the volume of air in the loudspeaker rear cavity) phenomena.

The system is controlled by the following linked equations (for a loudspeaker in the open air or mounted in a closed rear cavity):

$$u(t)=R_e*i(t)+BI(x)*dx/dt+d(L_e(x(t))*i(t)))/dt$$

$$BI(x)*i(t)+dL_e(x(t))/dx*i^2(t)=M_{ms}*d^2x/dt^2+R_{eq}*dx/dt+K_{eq}(x)*x$$

u being the voltage applied to the loudspeaker terminals,
i being the current through the coil,
x being the displacement of the diaphragm,
$R_e$ being the electrical resistance of the system,
$M_{ms}$ being an equivalent mass modeling the total mass of the moving armature of the system,
$R_{eq}$ being an equivalent resistance modeling the frictions and mechanical losses of the system,
$L_e$ being the electrical inductance of the system,
BI being the driving force factor (the product of the magnetic field in the gap by the coil length), and
$K_{eq}$ being an equivalent stiffness modeling the overall stiffness of the suspension (spider, external suspension and cavity).

The first three parameters ($R_e$, $M_{ms}$ and $R_{eq}$) are linear parameters, the equivalent mass $M_{ms}$ even being an invariant, supposed to be known according to the specifications of the manufacturer. On the other hand, $R_e$, and $R_{eq}$, which may be considered as constants over a short period (the time for their estimation) are parameters liable to progressively drift over time as a function of the rising in temperature of the moving coil, of the ageing of the components, etc. and they thus must be re-evaluated at regular intervals.

The last three parameters ($L_e$, BI and $K_{eq}$) are nonlinear parameters, which depend on the instantaneous value of the displacement x of the diaphragm. They may be approximated by polynomial models:

$$BI(x)=BI_0+BI_1x+BI_2x^2$$

$$K_{eq}(x)=K_{eq0}+K_{eq1}x+K_{eq2}x^2$$

$$L_e(x)=L_{e0}+L_{e1}x+L_{e2}x^{2+}L_{e3}x3+L_{e4}x^4$$

The complete knowledge of the model thus requires the determination of the linear parameters $R_e$ and $R_{eq}$, and that of the polynomial coefficients of the nonlinear parameters BI, $K_{eq}$ and $L_e$.

The set of these parameters will be called hereinafter the "state vector" X, with $X=[R_e, R_{eq}, BI_0, BI_1, BI_2, K_{eq0}, K_{eq1}, K_{eq2}, L_{e0}, L_{e1}, L_{e2}, L_{e3}, L_{e4}]^T$.

The displacement x, which is a parameter that is not measured, will be a hidden variable of the estimator.

The preceding equations being written in continuous time, if it is desired to switch to discrete mode (corresponding to a digital sampling), the Euler transform is used, which gives:

$$u_n=R_e*i_n+L_e'(x_n)*v_n*i_n+L_e(x_n)*j_n+BI(x_n)*v_n \quad \text{Eq. (1)}$$

$$BI(x_n)*i_n+Le'(x_n)*i_n^2=M_{ms}*F_s*(v_{n+1}-v_n)+R_{eq}*v_n+K_{eq}(x_n)*x_n \quad \text{Eq. (2)}$$

where $v_n=F_s*(x_{n+1}-x_n)$ represents the speed of displacement of the diaphragm, $F_s$ being the sampling frequency and $j_n=F_s*(i_{n+1}-i_n)$ being the derivative of the current.

It will be noted that this system of equations may also be extended to the estimation of the response of a loudspeaker mounted with a rear cavity comprising an outward vent, for example of the "bass-reflex" type. A third equation should then be added to the model:

$$xp_n = 2*xp_{n-1}-xp_{n-2}+(-F_s*(R_{boxm}+R_{pm})*(xp_{n-1}-xp_{n-2})-K_{boxm}*(xp_n+x_n)-R_{boxm}*F_s*(x_{n+1}-x_n))/(F_s^2*M_{pm}) \quad \text{Eq. (3)}$$

where xp (which will be a second hidden variable of the estimator) represents the displacement of the mass of air contained in the vent, and $M_{pm}$, $R_{boxm}$, $K_{boxm}$ and $R_{pm}$ are known parameters depending on the size of the vent and of the rear cavity.

Figure 3:
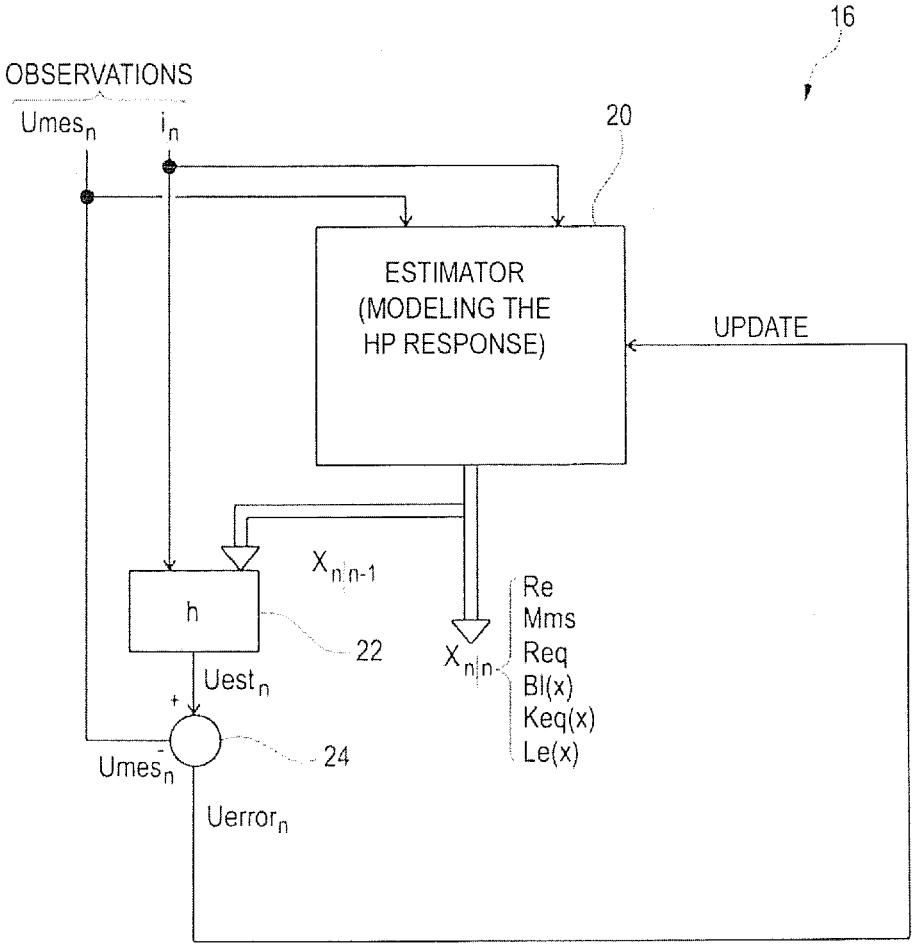
FIG. 3 illustrates more precisely the operation of the extended Kalman filter estimator.
Figure 2:
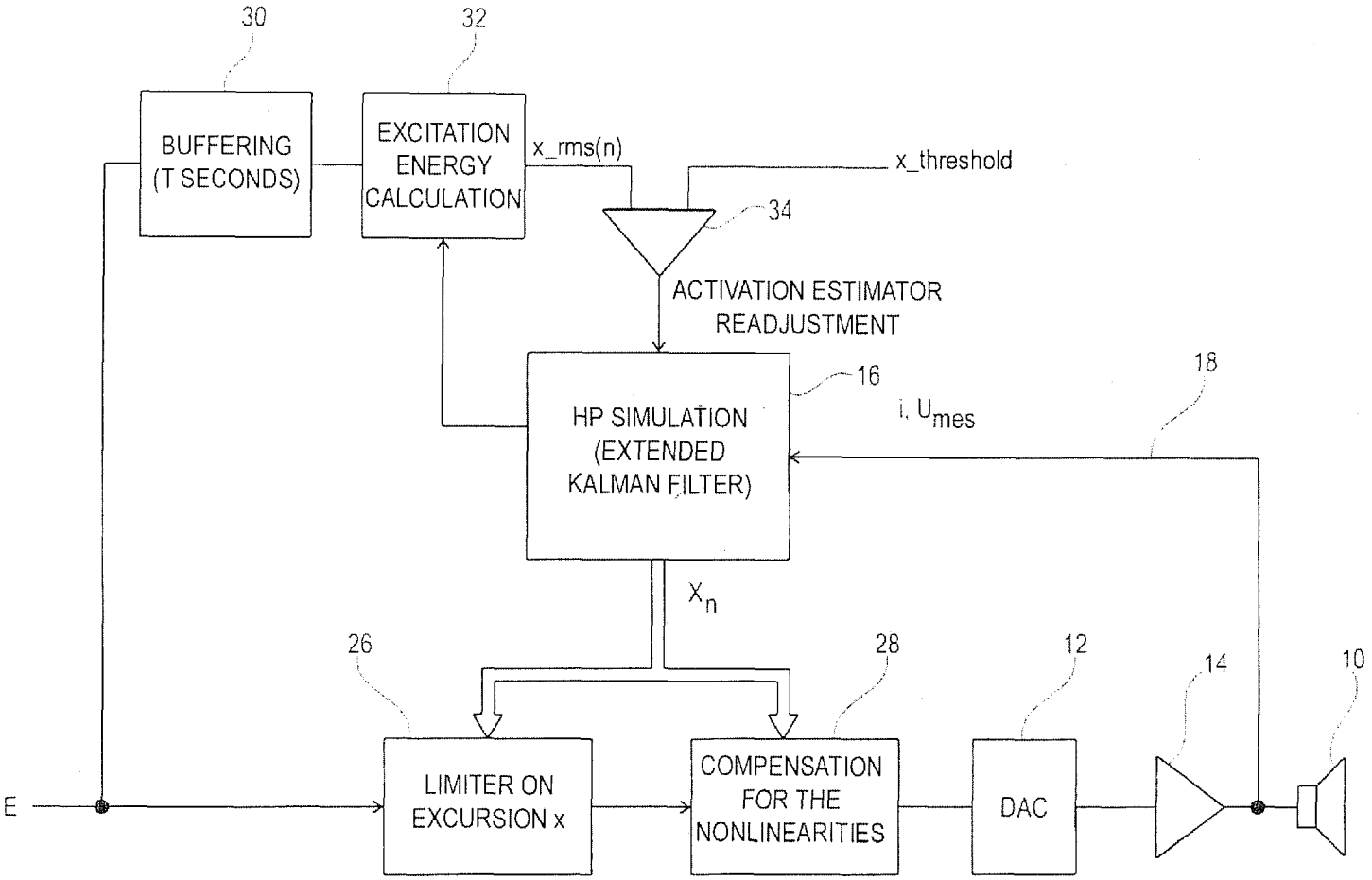
FIG. 2 illustrates, as a block-diagram, the main steps of processing of the method of the invention.

Application of an Extended Kalman Filter to the Estimation of the Response of a Loudspeaker With reference to FIGS. 2 and 3, we will now describe the method of the invention, allowing estimating the various parameters of the loudspeaker to apply to the audio signal suitable processing operations taking into account the modeling of the response of the latter.

It will be noted that, although these diagrams are presented as interconnected circuits, various functions is are essentially software-implemented, this representation having no illustrative character. The software may notably be implemented in a dedicated digital signal processing chip of the DSP type.

In concrete terms, the processing operations that will be described are performed on previously digitalized signals, the algorithms being executed iteratively at the sampling frequency for the successive signal frames, for example frames of 1024 samples.

Characteristically, the present invention implements a Kalman filtering, and more precisely, an extended Kalman filtering (EKF), the great lines of which will be exposed again hereinafter.

Basic Principles of the Extended Kalman Filter

The "Kalman filter", which is based on a widely known algorithm, is a state estimator comprising an infinite pulse response (IIR) filter that estimates the states of a dynamic system based on a set of equations describing the system behavior and on a series of observed measurements.

Such a filter allows in particular determining a "hidden state", which is a parameter that is not observed but that is essential for the estimation.

In the present case:

- the dynamic system is the loudspeaker response;
- the equations describing the behavior of the system are the above Equations (1), (2) and possibly (3);
- the observed measurements applied at the filter input are the voltage applied to the loudspeaker terminals and the current passing through the coil of the latter; and
- the hidden state is the instantaneous excursion, i.e. the physical displacement of the diaphragm with respect to its equilibrium position, which is an essential parameter for the estimation of the nonlinear parameters of the loudspeaker response, as exposed hereinabove.

The Kalman filter operates in two phases, with successively:

1°) a prediction phase, performed at each iteration of the filter: this phase consists in predicting the loudspeaker response at the current instant with respect to the previous instant according to an evolution equation; and 2°) a readjustment phase, which consists in correcting the prediction using the current measurements (voltage, current): the modeling of the response being then adapted and updated to take into account in particular systematic errors of measurement.

Application of the Extended Kalman Filer to the Estimation of the Loudspeaker Response Generally, if the formalism of the state representation is adopted, the first equation of the Kalman process is the "evolution equation" of the model:

$$x_k=F_kx_{k-1}+B_ku_k+w_k$$

$x_k$ being the state vector, representing the state at instant k, $F_k$ being the transition matrix (defined at the design of the filter), which determines the evolution of the state k−1 to the new state k, $B_k$ being a noise vector (Gaussian noise generated by the sensor), $u_k$ being a control vector (parameter at the input of the filter), and $w_k$ being a state representing the noise at instant k.

In the present case, the state vector $x_k$ is the vector composed of the parameters of the loudspeaker model:

$$x_k=[R_e,R_{eq},BI_0,BI_1,BI_2,K_{eq0},K_{eq1},K_{eq2},L_{e0},L_{e1},L_{e2},L_{e3},L_{e4}]^T$$

The second equation of the Kalman process is the "measurement equation":

$$z_k=H_kx_k+v_k$$

$z_k$ being the observation vector at instant k (voltage and current measurements), $H_k$ being the measurement matrix at instant k, i.e. the observation matrix linking the state to the measurement, determined at the design of the filter, and $v_k$ being the noise vector of the measurement at instant k.

The first step is the prediction of the model at instant k, based on the state at instant k−1, given by the following equations:

Prediction (a priori) of the estimated state $\hat{x}_{k|k-1}=F_k\hat{x}_{k-1|k-1}+B_ku_k$ Prediction covariance (a priori) $P_{k|k-1}=F_kP_{k-1|k-1}F_k^T+Q_k$ The second step is the updating of the model thanks to the observation of the measurement at instant k, by the following system of equations:

Innovation or measurement residue $\tilde{y}_k=z_k-H_k\hat{x}_{k|k-1}$

Innovation covariance $S_k=H_kP_{k|k-1}H_k^T+R_k$

Optimal Kalman gain $K_k=P_{k|k-1}H_k^TS_k^{-1}$

Update (a posteriori) of the estimated state $\hat{x}_{k|k}=\hat{x}_{k|k-1}+K_k\tilde{y}_k$ Update (a posteriori) of the covariance $P_{k|k}=(I-K_kH_k)P_{k|k-1}$ In the case of a linear system, the Kalman estimation is optimal within the meaning of the least squares of the hidden model.

However, it has been seen hereinabove that the dynamic model of the loudspeaker response that is used is not a linear model, so that the Kalman filter that has just been exposed is not applicable to the present invention.

For that reason, the method used will be that which is known under the name "extended Kalman filtering" or EKF.

The evolution equation of the model and the measurement equation are in the form:

$$x_k=f(x_{k-1},u_k)+w_k$$

$$z_k=h(x_k)+v_k$$

$f$ and h being nonlinear but differentiable functions.

The extended Kalman filtering consists in approximating these functions $f$ and h by their partial derivatives during the calculation of the covariance matrices (prediction matrix and update matrix), in order to locally linearize the model and to apply to it in each point the system of prediction and update equations of the Kalman filter exposed hereinabove. These systems of equations become, respectively:

Prediction (a priori) of the estimated state $\hat{x}_{k|k-1}=f(\hat{x}_{k-1|k-1},u_{k-1})$ Prediction covariance (a priori) $P_{k|k-1}=F_{k-1}P_{k-1|k-1}F_{k-1}^T+Q_{k-1}$ and:

Innovation or measurement residue $\tilde{y}_k=z_k-h(\hat{x}_{k|k-1})$

Innovation covariance $S_k=H_kP_{k|k-1}H_k^T+R_k$

Almost-optimal Kalman gain $K_k=P_{k|k-1}H_k^TS_k^{-1}$

Update (a posteriori) of the estimated state $\hat{x}_{k|k}=\hat{x}_{k|k-1}+K_k\tilde{y}_k$ Update (a posteriori) of the covariance $P_{k|k}=(I-K_kH_k)P_{k|k-1}$ The transition matrix and the observation matrix are the following Jacobian matrices (partial derivative matrices):

$$F_{k-1}=\frac{\partial f}{\partial x}\Big|_{\hat{x}_{k-1|k-1},u_{k-1}} \qquad H_k=\frac{\partial h}{\partial x}\Big|_{\hat{x}_{k|k-1}}$$

Practical Implementation of the Extended Kalman Filter to the Processing of an Audio Signal Reproduced by a Loudspeaker The operating method that has just been described may be implemented as schematically illustrated in FIG. 2.

A digitized audio signal E coming from a media player is acoustically reproduced by a loudspeaker 10 after digital/analog conversion (block 12) and amplification (block 14).

The response of the loudspeaker 10 is simulated by an extended Kalman filter (estimator of the block 16) using as an input the signals 18 collected on the loudspeaker 10, these signals comprising the voltage Umes applied to the loudspeaker terminals by the amplifier 14 and the current i circulating in the moving coil of the loudspeaker.

The operation of the extended Kalman filter 16 will be more particularly explained with reference to FIG. 3, where the block 20 schematizes the estimator of the Kalman filter based on the modeling of the loudspeaker response, the block 22 the function h of the measurement equation and the block 24 the comparison between the estimated state and the measured state, allowing the derivation of an error signal for updating the dynamic model.

The parameters of the model to be estimated form at instant n the state vector $X_n$ (the parameter $M_{ms}$ of the mode being supposed to be known and invariant):

$$X_n[BI_0, K_{eq0} Le_0, R_{eq}, R_e, BI_1, K_{eq1}, Le_1, BI_2, K_{eq2}, L_{e2}, L_{e3}, L_{e4}]^T$$

It will be considered that the model of the loudspeaker response is invariant during the time required for the estimation. For example, if a fraction of T=10 seconds of the signal is used for the estimation, it will be supposed that the model remains the same during this time T, to within an evolution noise.

Therefore, the evolution equation of the state comes down to:

$$X_{n+1}=X_n$$

The measurement of the voltage at the loudspeaker terminals constitutes the only component of the observation vector $Umes_{n-1}$. This measurement is compared to the estimated voltage $Uest_n=h(X_n)$ obtained with the estimations of the parameters at instant n and the measured current i:

$$Uest_n=R_e*i_n+L_e'(x_n)*v_n*i_n+L_e(x_n)*j_n+BI(x_n)*v_n$$

$x_n$, being herein a hidden variable of the displacement, calculated recursively by means of the Equations (1) et (2).

The algorithm then calculates the derivative of the function h with respect to each of the components of the vector X: dh(X)/dBI0, dh(X)/dKeq0, . . . which corresponds to the partial derivative of the estimated voltage, with respect to each of the parameters of the model.

If one of these parameters is generally noted p, deriving the Equation (A) with respect to p gives:

$$d(Uest_n)/dp=(L_e''(x_n)v_n i_n+Le'(x_n)j_n+Bl'(x_n)v_n)*dx_n/dp+(L_e'(x_n)i_n+Bl(x_n))*dv_n/dp+dBl(x_n,p)/dp*v_n+dL_e(x_n,p)/dp*j_n+dL_e'(x_n,p)/dp*v_n*i_n$$

and deriving and rearranging the Equation (2) with respect to p gives:

$$d(v_n)/dp=(1-T_s*R_{eq}/M_{ms})*d(v_{n-1})/dp+T_s/M_{ms}*(L_e''(x_{n-1})*i_{n-1}^2+Bl'(x_{n-1})*i_{n-1}-K_{eq}'(x_{n-1})x_{n-1})-K_{eq}(x_{n-1}))*d(x_{n-1})/dp+T_s/M_{ms}*(dBl(x_{n-1})/dp*i_{n-1}+dL_e'(x_{n-1})/dp*i_{n-1}^2-dK_{eq}(x_{n-1})/dp*x_{n-1}-dR_{eq(n-1)}/dp*v_{n-1})$$

and:

$$d(x_n)/dp=d(x_{n-1})/dp+T_s*d(v_{n-1})/dp$$

These equations allow calculating recursively the Jacobian matrix (which, in the present case, is a simple vector):

$$H=[dUest/dBI_0, dUest/dK_{eq0}, \ldots, dUest/dL_{e4}]$$

The various steps of the algorithm may be recapped as follows:

1°) Prediction of the system (using the model and the noise of the model):

$$X_{n|n-1}=X_{n-1|n-1}$$

$$P_{n|n-1}=P_{n-1|n-1}+Q_n$$

$Q_n$ being the covariance matrix of the noise of the model

2°) Update of the system:

$$Uest_n=h(X_{n|n-1})$$

$$Uerror_n=Umes_n-Uest_n$$

Calculation of $H_n=[dUest_n/dBI_0, dUest_n/dK_{eq0}, \ldots, dUest_n/dL_{e4}]$ $$S_n=H_nP_{n|n-1}H_n^T+R_n$$

$S_n$ being the error matrix of the update, $R_n$ being the covariance matrix of the observation noise, $K_n$ being the gain by which the error is multiplied, $X_{n|n}$ being the state vector to be estimated, and $P_{n|n}$ being the update of the covariance matrix (describing the noise)

$$K_n=P_{n|n-1}H_n^TS_n^{-1}$$

$$X_{n|n}=X_{n|n-1}+K_n*Uerror_n$$

$$P_{n|n}=(I-K_nH_n)P_{n|n-1}$$

The estimation of the parameters of the model of the loudspeaker at instant n is given by the state vector $X_{n|n}$.

The thus-obtained state vector $X_{n|n}$ may be used for various purposes.

The knowledge of the loudspeaker response, and notably of the excursion x of the diaphragm (hidden variable, not measured but estimated thanks to the extended Kalman filter) may notably serve as input data to a limiter stage 26 (FIG. 2): the instantaneous value x of the excursion is compared to a determined threshold $x_{max}$ beyond which this excursion is considered as been too high, with a risk of damaging the loudspeaker, of occurrence of distortions, etc. If the threshold is exceeded, the limiter determines an attenuation gain, lower than the unit, which will be applied to the incident signal E to reduce the amplitude thereof, so that the excursion remains in the allowed range.

Another processing that may be applied to the audio signal is a compensation for the nonlinearities (block 28). Indeed, insofar as the loudspeaker response is modeled, it is possible to predict the nonlinearities of this response and to compensate for them by a suitable reverse processing, applied to the signal. Such a processing is known per se and will thus not be described in more detail herein.

It will be noted that a compensation for the nonlinearities is liable to add power to the signal obtained at the output. It is therefore necessary at this stage to verify that the signal compensated for the nonlinearities does not exceed an allowable limit of excursion of the diaphragm—in the opposite case, an overall gain of attenuation, lower that the unit, will be applied to the signal so that this excursion remains in the allowed range.

According to another aspect of the invention, the extended Kalman estimator operates on-the-fly, directly based on the current audio signal reproduced by the loudspeaker, by collection of the electrical parameters on this loudspeaker (voltage, current) during the reproduction of this audio signal.

Indeed, there exists no theoretical constraints on the signal exciting the diaphragm of the loudspeaker so that the method of estimation by the extended Kalman filter can be implemented.

The system will then be usable with a general public high-fidelity equipment, operating transparently for the user: there is no need to ask the latter to reproduce a particular type of calibration signal (white noise, succession of tones, etc.) in order for the algorithm to be able to estimate the parameters of the loudspeaker, the latter being capable of operating in a continuous manner when music is played.

However, in order to estimate at best the linear and nonlinear parameters of the T/S model, in particular the BI(x), $K_{eq}(x)$ and $L_e(x)$ parameters that depend on the displacement x of the diaphragm, it is preferable that the signal played makes this diaphragm displace enough so that the estimation can be the best possible.

To decide if an excitation signal E may be used to update the Kalman estimator, when music is played, the last T seconds (typically T=10 seconds) of the signal are permanently kept in memory in a buffer 30 (FIG. 2)

The displacement of the diaphragm is permanently calculated by application of the Equations (1) and (2) to the estimator (block 32), with loudspeaker parameters that are fixed and that correspond to the results of the last estimation operated by the Kalman filter.

The root-mean-square value x_rms(n) of this displacement is calculated (block 32) every N samples (typically N=24000 samples), for example by the following formula:

$$x_rms(n)=\mathrm{sqrt}((x(n)^2+x(n-1)^2+\ldots+x(n-N)^2)/N)$$

If this root-mean-square value is higher than a given threshold x_threshold (block 34) during a number of consecutive times corresponding to the time T, then it is considered that the last T seconds of the signal played are valid and that the updating of the Kalman filter is activated in such a manner that the latter can use these last T seconds of signal to re-estimate the parameters of the loudspeaker response.

The invention claimed is:

1. A method for processing a digital audio signal intended to be reproduced by an equipment including an electrodynamic loudspeaker whose overall response as a function of the electrical signal applied to its terminals is defined by a set of electrical, mechanical and acoustical parameters, the method comprising:

a) the determination of an observation vector comprising only measurements of electrical parameters, with:
- a measurement of the voltage (U) at the loudspeaker terminals, and
- a measurement of the current (i) through the loudspeaker;

b) the determination of a state vector (X) by application of the voltage and current measurements to a predictive filter estimator incorporating a representation of a dynamic model of the loudspeaker,
- this predictive filter being an extended Kalman filter adapted to:
- operate a prediction of the state vector (X), and
- readjust this prediction by calculation of an estimate of the voltage (Uest) based on the state vector and on the current measured and comparison of this estimate to the voltage measurement ($U_{mes}$);

c) the application to the audio signal of a processing that is a function of the state vector (X), characterized in that the components of the state vector comprise:
- values of linear parameters of the loudspeaker response comprised in the group: electrical resistance ($R_e$) and mechanical strength ($R_{eq}$), and
- polynomial coefficients of nonlinear parameters of the loudspeaker response comprised in the group: force factor ($BI_0$, $BI_1$, $BI_2$), equivalent stiffness ($K_{eq0}$, $K_{eq1}$, $K_{eq2}$) and electrical inductance ($L_{e0}$, $L_{e1}$, $L_{e2}$, $L_{e3}$, $L_{e4}$); and d) reproducing the audio signal by the equipment.

2. The method of claim 1, wherein said processing applied to the audio signal is a processing of compensation for the nonlinearities of the loudspeaker response, as determined based on the state vector delivered by the predictive filter estimator.

3. The method of claim 1, wherein said processing applied to the audio signal comprises:

c1) the calculation of a current value of excursion (x) of the loudspeaker as a function i) of an amplification gain of the audio signal and ii) of the loudspeaker response as determined based on the state vector delivered by the predictive filter estimator;

c2) the comparison of the thus-calculated current value of excursion with a maximal value of excursion; and c3) the calculation of a possible attenuation of said amplification gain in the case where the current value of excursion exceeds the maximal value of excursion.

4. The method of claim 1, wherein the components of the state vector (X) further comprise values of additional acoustical parameters representative of the loudspeaker response associated with a rear cavity provided with a decompression vent.

5. The method of claim 1, wherein the determination of the state vector of step b) is operated on-the-fly based on the current audio signal object of the processing of step c) and reproduced by the loudspeaker, by collection of the electrical parameters at the loudspeaker terminals during the reproduction of this audio signal.

6. The method of claim 5, comprising the following steps:

memorizing a sequence of samples of the audio signal for a predetermined duration;

analyzing the sequence for calculating a parameter of energy of the memorized audio signal;

if the calculated parameter of energy is higher than a predetermined threshold, activating the estimation by the predictive filter;

in the opposite case, inhibiting the estimation by the predictive filter and keeping the previously estimated values of the state vector.

* * * * *